US007542060B2

(12) United States Patent
Koyabu et al.

(10) Patent No.: US 7,542,060 B2
(45) Date of Patent: Jun. 2, 2009

(54) THERMAL PRINTER AND THERMAL PRINTER CONTROL METHOD

(75) Inventors: Akira Koyabu, Shiojiri (JP); Satoshi Nakajima, Azumino (JP); Yuji Takiguchi, Shiojiri (JP)

(73) Assignee: Seiko Epson Corporation (JP)

( * ) Notice: Subject to any disclaimer, the term of this patent is extended or adjusted under 35 U.S.C. 154(b) by 520 days.

(21) Appl. No.: 11/492,489

(22) Filed: Jul. 24, 2006

(65) Prior Publication Data

US 2007/0019062 A1 Jan. 25, 2007

(30) Foreign Application Priority Data

Jul. 25, 2005 (JP) ..... 2005-213800

(51) Int. Cl.
*B41J 2/36* (2006.01)

(52) U.S. Cl. ..... 347/195; 347/196

(58) Field of Classification Search ..... 347/195, 347/196, 171, 188
See application file for complete search history.

(56) References Cited

U.S. PATENT DOCUMENTS

| | | | | |
|---|---|---|---|---|
| 5,184,150 | A * | 2/1993 | Sugimoto | 347/196 |
| 5,483,273 | A * | 1/1996 | Fujimoto et al. | 347/195 |
| 6,057,870 | A * | 5/2000 | Monnier et al. | 347/171 |
| 7,271,818 | B2 * | 9/2007 | Mason | 347/196 |

FOREIGN PATENT DOCUMENTS

| | | |
|---|---|---|
| JP | 03-231869 | 10/1991 |
| JP | 06-127012 | 5/1994 |
| JP | 08-011342 | 1/1996 |
| JP | 10-129029 | 5/1998 |
| JP | 10-193664 | 7/1998 |

* cited by examiner

*Primary Examiner*—Stephen D Meier
*Assistant Examiner*—Rene Garcia, Jr.
(74) *Attorney, Agent, or Firm*—Baker Hostetler, LLP

(57) ABSTRACT

High print quality from a thermal printer is maintained while the print speed is decreasing without producing white streaks or uneven print density by controlling the hysteresis coefficient of the thermal print head 35 based on the energizing history of the thermal print head 35 and print speed control factors used for determining print speed, which is the speed at which the paper is advanced while printing. The thermal printer, comprises a hysteresis coefficient setting unit 2 for setting a hysteresis coefficient for the print head based on the energizing history of the thermal print head 35; an energizing time calculation unit 3 for calculating the energizing time during which drive signals are to be applied to the thermal print head 35 for printing based upon the hysteresis coefficient set by the hysteresis coefficient setting unit; a printing control device 4 for generating the drive signals to be applied to the print head in response to the energizing time calculated by the energizing time calculation unit 3; a print speed determination unit 5 for determining the change in the print speed and when the print speed is decreasing; and a coefficient changing unit 6 for changing the hysteresis coefficient when a change in print speed occurs causing the print speed to decrease. Preferably the coefficient changing unit changes the hysteresis coefficient to a value greater than the hysteresis coefficient value used immediately before deceleration.

8 Claims, 11 Drawing Sheets

THERMAL PRINTER AND THERMAL PRINTER CONTROL METHOD

BACKGROUND OF THE INVENTION

1. Field of technology

The present invention relates to a thermal printer and to a control method for the thermal printer.

2. Description of Related Art

Thermal printers hold the thermal paper between the thermal print head and a platen roller and advance the paper by rotating the platen roller. The thermal print head has heating elements (dots) arrayed in a line (one dot line) across the width of the paper, and applies current to selected or all of the heating elements in this dot line to produce heat and cause the thermal paper to change color. The thermal printer prints "dots" by energizing the thermal print head while advancing the thermal paper. Torque for rotating the platen roller is transferred from a rotational drive source such as a stepping motor through a transfer mechanism (a gear train) to the platen roller.

The printing speed of a thermal printer is determined by various parameters, including the energizing voltage applied to the thermal print head, the print duty (the ratio of printed dots to the number of total dots in one dot line), the temperature of the print head, printing pattern, print data communication speed, and the amount of time required for internal data processing. These parameters are hereinafter referred to individually or collectively as "print speed control factors". A change in one or more of the print speed control factors changes the print head energizing time and print speed. The print head energizing time and print speed are adjusted according to change in these print speed control factors in order to achieve the best print quality. The print speed of a thermal printer is equal to the paper feed rate because printing occurs while the paper is advanced.

Various control methods have been proposed for assuring good print quality when the print speed is changed based on changes in the print speed determination factors.

The control method taught in Japanese Unexamined Patent Appl. Pub. H03-231869 supplies more electrical energy to the thermal print head when the print speed is increasing or decreasing than when the print speed is constant.

The control method taught in Japanese Unexamined Patent Appl. Pub. H10-193664 measures the print head temperature and determines the print speed to control the pulse width (the thermal print head energize time and electrical energy) of a strobe signal comprising the thermal print head temperature and print speed.

The print quality of the dots printed on the thermal paper is affected by the accumulation of heat in each heating element in the print head preceding the printing of current dots. It has been discovered that by controlling the setting of the hysteresis coefficient of the thermal print head according to print speed and by changing the print speed based on the energizing history of each printed dot superior print quality can be achieved. The hysteresis coefficient can be set at multiple values based on the history of the energy applied over a period of forming multiple dots but it is preferred to set the hysteresis coefficient based on the immediately preceding application of energy to each heating element in the print head and to change the setting during the period of print deceleration.

It has been discovered that print quality varies particularly easily when the print speed decreases. When the print duty of the content to be printed is high (such as when printing solid black or during logo printing as described below), the print speed is reduced in order to avoid overheating the thermal print head and a drop in the energizing voltage, but this can also result in the print density varying.

When printing a receipt with a thermal printer in a POS terminal, for example, the store name, purchase information including the name and price of each purchased product, and a logo for the store or sales campaign are typically printed. In this case text such as the store name and the purchase information may be printed first at the beginning of the receipt, and then followed by printing a logo for a sales campaign, for example. The print duty differs greatly during logo printing of graphic data as compared to printing text, and the print speed therefore also changes. More specifically, the print duty is low and the print speed is high when printing text, and the print duty is high and the print speed is low during logo printing. There is therefore a transition from printing text to logo printing when printing both text and a logo continuously on a receipt, and the print speed decreases (gradually) at this transition from text to logo printing. As a result, when the print duty is high, the print speed is reduced so that the energizing interval (non-energized time) increases. This may be accomplished by increasing the pulse width of the strobe signal (drive signal). As shown in FIG. 11, however, the print density is unstable while the print speed is slowing, and white lines and uneven print density appear in the transition area from the deceleration range to the low speed range where the print speed is constant. As a result, print quality cannot be assured by changing only the pulse width of the strobe signal.

The print quality is easily affected by change in heat accumulation when the print speed is changed. More specifically, the cooling time of the thermal print head is shortened because the energizing interval is short during the high print speed period preceding deceleration, and because heat accumulation from the previously energized dot affects energization of the heating element in the formation of the next dot. During deceleration, however, the thermal print head cooling time increases because the energizing interval increases, and the effect of heat accumulation from the previously energized dot on the formation of the next dot is small. Controlling printing with consideration for the effect of heat accumulation has therefore been found to be necessary while the print speed is decreasing.

The present invention is directed to a thermal printer and a thermal printer control method for enabling printing with good print quality while reducing the print speed without causing streaks and uneven print density in the printed output.

SUMMARY OF THE INVENTION

The thermal printer of the present invention controls print speed based on print speed control factors and comprises a hysteresis coefficient setting unit for setting a hysteresis coefficient based on a thermal print head energizing history; an energizing time calculation unit for calculating an energizing time of a drive signal applied to the thermal print head based on the hysteresis coefficient setting; a print head control unit for applying the drive signal generated based on the calculated energizing time to the thermal print head; a speed change acquisition unit for determining change in the print speed; and a coefficient changing unit for setting the hysteresis coefficient used when the print speed is decreasing to a value greater than the hysteresis coefficient used immediately before deceleration when the speed change acquisition unit determines that the print speed is decreasing.

The control method of the present invention controls the print speed of a thermal printer based on print speed control factors and comprises the steps of: setting a hysteresis coefficient based on a thermal print head energizing history; calculating an energizing time of a drive signal applied to the thermal print head based on the hysteresis coefficient setting; determining change in the print speed; and changing the hysteresis coefficient used when the print speed is decreasing to a value greater than the hysteresis coefficient used immediately before deceleration when the print speed is determined to be decreasing.

When the print speed is decreasing, the hysteresis coefficient is increased and the adjustment in the energizing time of the drive signal(s) applied to the thermal print head is decreased. The effect of heat accumulation is smaller when the print speed is slowing, and the energizing time of the drive signal applied to the dot addressed by the hysteresis coefficient is therefore increased compared with the value of the hysteresis coefficient immediately before the deceleration (when the print speed is high (constant) or accelerating). Printing with good quality and no white streaks or uneven print density is therefore possible when the print speed is decreasing.

The hysteresis coefficient is a coefficient for controlling the amount of electrical energy applied to each dot of the thermal print head to print based on the preceding energizing history (print history) of the thermal print head. For example, if the energization of the print head used to print each dot is the same used to print the previous line (one dot before), each energized heating element forming the dot will not cool sufficiently because the supplied electrical energy accumulates heat, and the temperature of the heating element forming the dot rises and does not return to the temperature before the electrical energy was applied. If electrical energy is applied for the same energizing time to print the next dot, the thermal printer generally overheats excessively, and the accumulated heat contributes to a drop in print quality appearing as bleeding and malformed dots in the printed text. To prevent this, the amount of electrical energy used to energize the next dot is adjusted (decreased) based on the accumulation of heat in the thermal print head due to being previously energized. The hysteresis coefficient is the coefficient that determines this adjustment.

In a preferred aspect of the invention the energizing time calculation unit calculates the energizing time based on the product of the hysteresis coefficient and a predetermined reference energizing time that is a reference for the energizing time; and the reference energizing time is constant during deceleration and the period immediately before deceleration.

This aspect of the invention assures good print quality during the deceleration period by simply increasing the value of the hysteresis coefficient to increase the energizing time of the drive signal for the dot addressed by the hysteresis coefficient without also controlling the reference energizing time. High quality printing can therefore be assured without the complexity of changing the reference energizing time based on the print speed determination factors, also changing the hysteresis coefficient, and then recalculating the energizing time.

Further preferably, the thermal printer also has a print duty calculation unit for calculating the print duty, which is a print speed determination factor, based on print data, and the hysteresis coefficient setting unit sets the hysteresis coefficient based on the calculated print duty.

When a thermistor or other temperature detection device is used to measure heat accumulation by the thermal print head, that is, the print head temperature, it is difficult for the temperature detection device to measure the temperature without a time lag from the actual temperature change. Setting the hysteresis coefficient may therefore be delayed from the actual temperature change. The print duty (representing the ratio of printed dots to the number of total dots in one dot line or print data) is indicative of the total applied electrical energy, and can therefore be used instead of actually measuring the temperature of the thermal print head. Therefore, by setting the hysteresis coefficient based on the print duty, this aspect of the invention can suitably control setting the hysteresis coefficient applied to the thermal print head with no delay between the actual temperature change and setting the hysteresis coefficient.

In this aspect of the invention the speed change acquisition unit preferably gets the speed change based on the print speed determination factors.

This aspect of the invention enables predicting the speed change. As a result, setting the hysteresis coefficient applied to the thermal print head when the print speed is decreasing can be suitably controlled with no delay between the actual decrease (deceleration) in the print speed and resetting of the hysteresis coefficient.

Other advantages and attainments of the invention will become apparent and appreciated by referring to the following description and claims taken in conjunction with the accompanying drawings.

DESCRIPTION OF THE PREFERRED EMBODIMENTS

Print Speed Variation State

The thermal printer and control method of the present invention assures good print quality by monitoring the print speed variation state particularly during print speed deceleration. The print speed variation state as used herein is the state in which the print speed V (see FIG. 3) increases or decreases continuously for a predetermined period of time. As described above, the print duty often differs greatly when printing text and when printing a logo or other graphic, and the print speed V decreases continuously over a predetermined period of time during the transition from text printing to logo printing (such as during deceleration period 11 in FIG.

3). A drop in print quality is particularly pronounced when the rate of the decrease in the print speed V (the rate of deceleration) is high. More specifically, the drop in print quality increases as the drop in print speed V increases and the deceleration time decreases. In addition to the rate of deceleration, the effects of inertia and torque load on print quality also generally tend to be greater in a thermal printer 1 with a wide printing width.

Energizing time

The reference energizing time T (see FIG. 3) that is used as the reference for the drive signal (strobe signal) applied to the thermal print head remains constant when the print speed V is decreasing and when the print speed V is constant. This enables maintaining good print quality by simply increasing the value of the hysteresis coefficient (Q->Q') during the deceleration period without also adjusting the reference energizing time T. Printing with suitable print quality is therefore possible without requiring the complexity of a control method that changes the reference energizing time T based on the print speed determination factors and also changes the hysteresis coefficient to calculate the energizing time.

Hysteresis Coefficient

Plural hysteresis coefficients can be desirably preset according to the characteristics and use of the thermal printer 1.

Plural hysteresis coefficients can be set according to the history of energizing heating elements in the print head for forming a particular dot or plural dots before forming a current dot. However, because the energy applied to the immediately preceding dot has the greatest effect on the print quality of the current dot, only one hysteresis coefficient (Q or Q') is set according to the energy applied to the immediately preceding dot in this embodiment of the invention.

Figure 2:
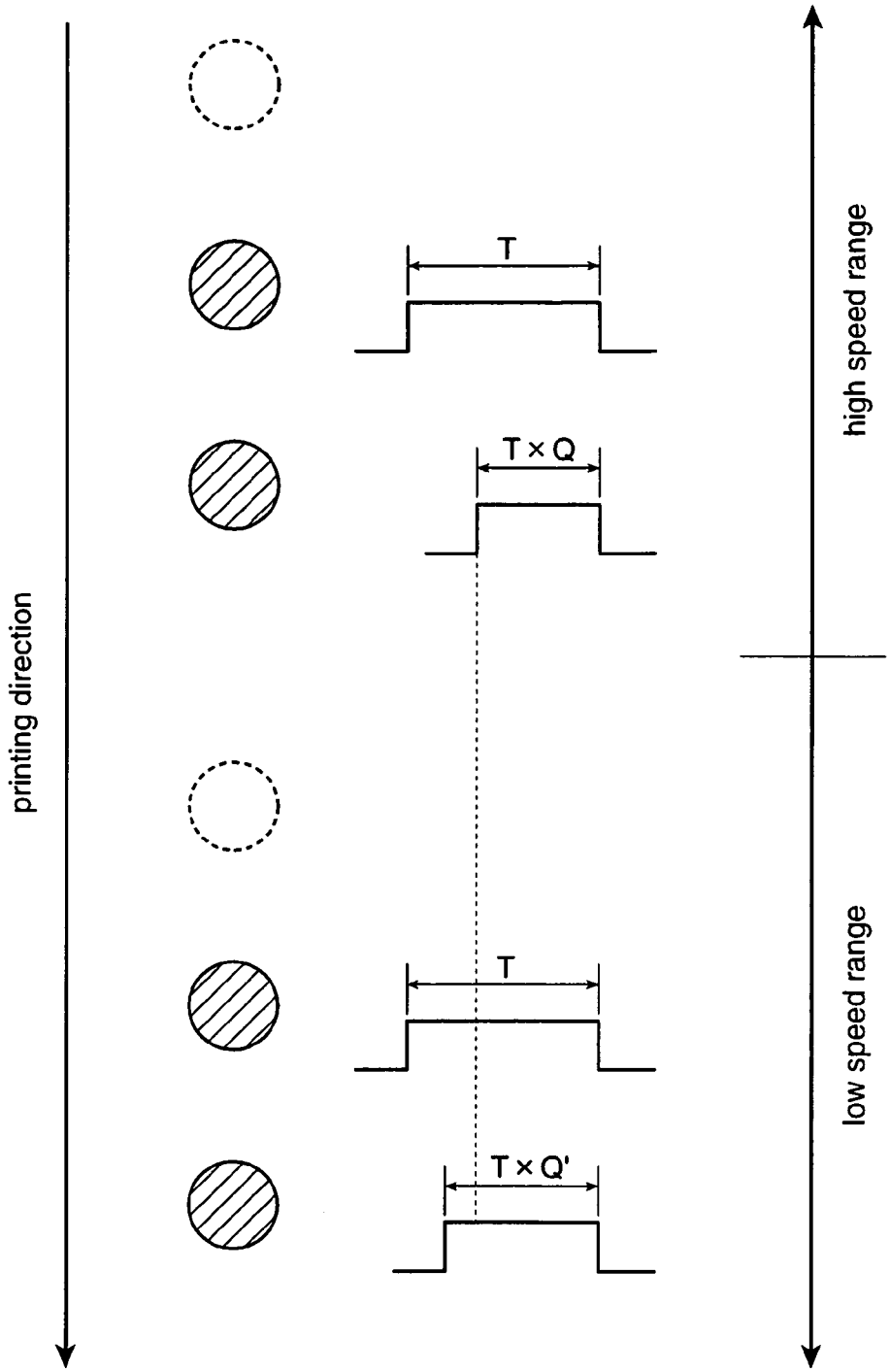
FIG. 2 describes the energizing time of the drive signal in a thermal printer.

FIG. 2 shows the energizing time in the high speed range and the deceleration range when the second preceding dot did not print and the first preceding dot printed. In both cases a drive signal of reference energizing time T is applied to the printing dot because the dot before the printing dot (that is, two dots before the printing dot) did not print and there is no heat buildup from that dot. However, because the dot immediately before the next dot to be printed (that is, the dot one dot before the printing dot) printed, there is accumulated heat and the energizing time of the applied drive signal is determined from the reference energizing time T and the hysteresis coefficient.

As shown in FIG. 2 the hysteresis coefficient Q' used in the deceleration period is greater than the hysteresis coefficient Q used when the print speed is constant. More specifically, the adjustment (decrease) in electrical energy due to the hysteresis coefficient is less. Because the energizing interval is greater during deceleration, the cooling time of the thermal print head 35 is also greater, and heat accumulation therefore has less effect. The decrease in the energizing time of the drive signal applied to each dot addressed by the hysteresis coefficient of the thermal print head 35 is therefore reduced by increasing the value of the hysteresis coefficient, and print quality can therefore be improved. Good print quality can therefore be assured in the deceleration period by thus changing the hysteresis coefficient.

The hysteresis coefficient is preferably set according to the printing pattern or print duty. Suitable hysteresis coefficients are also preferably set and stored according to the rate of decrease in the print speed V. This enables a suitable hysteresis coefficient to be determined and applied quickly.

Figure 3:
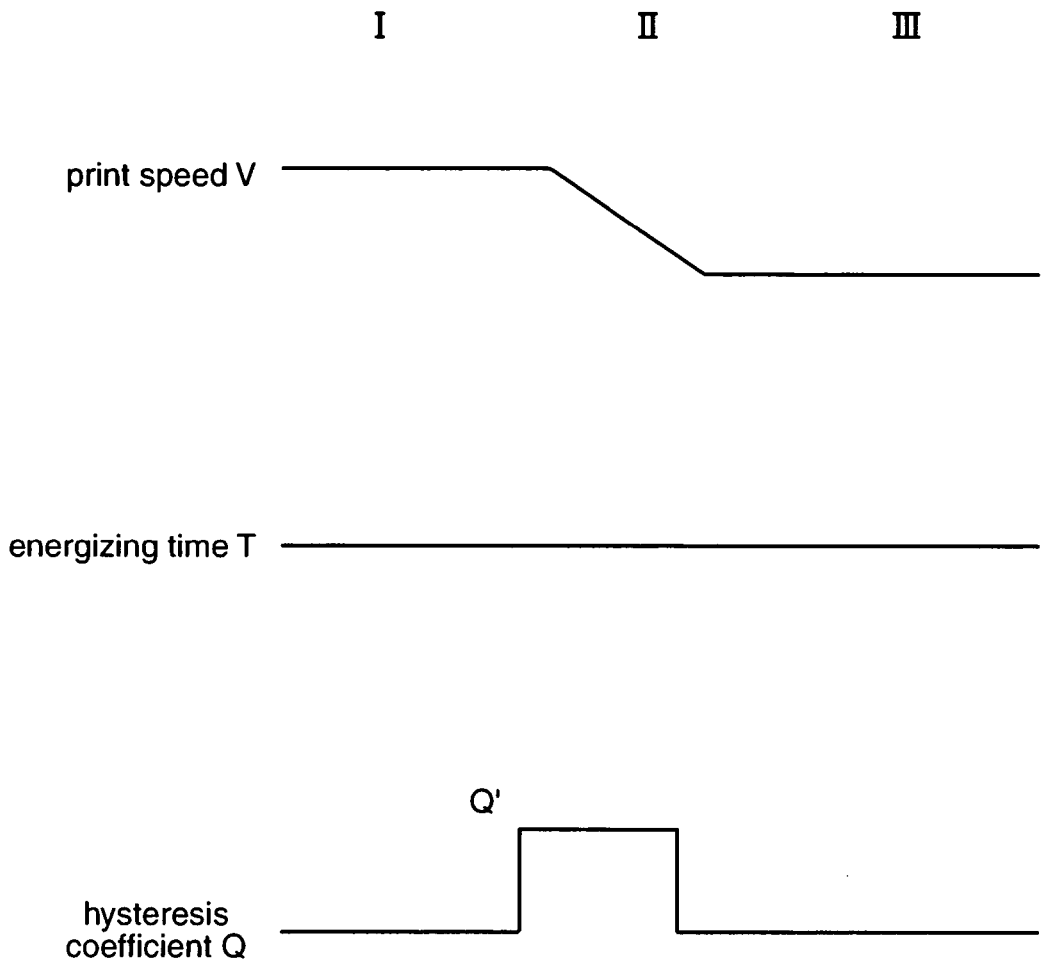
FIG. 3 describes the relationship between print speed, energizing time, and the hysteresis coefficient in a sample printing pattern printed by a thermal printer.

FIG. 3 shows the relationship between print speed V, reference energizing time T, and hysteresis coefficient Q (Q') from high speed period I through deceleration period II and to low speed period III. As shown in FIG. 3, the energizing time T is constant regardless of the print speed V. In addition, the hysteresis coefficient Q' in deceleration period Ii is greater than the hysteresis coefficient Q in the high speed period I.

Figure 4:
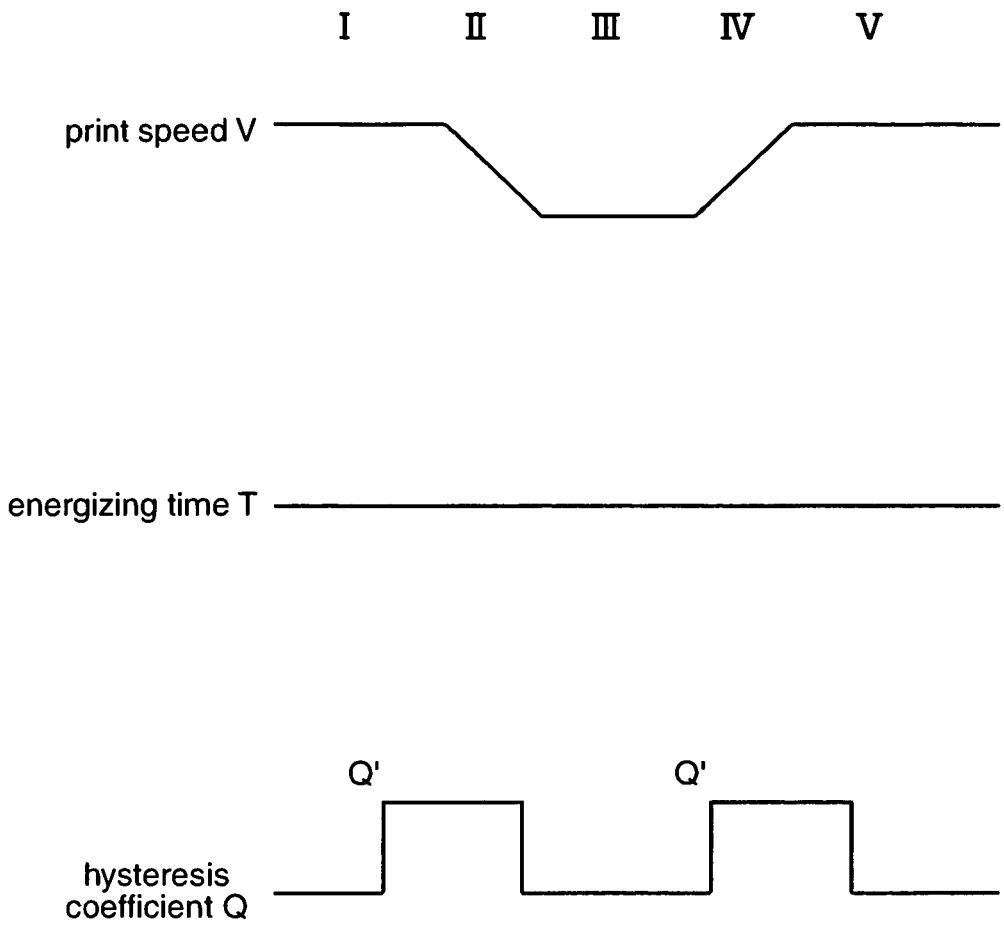
FIG. 4 describes the relationship between print speed, energizing time, and the hysteresis coefficient in another sample printing pattern printed by a thermal printer.

FIG. 4 shows the relationship between print speed V, reference energizing time T, and hysteresis coefficient Q (Q') through acceleration period IV to high speed period V after low speed period III. In this example the hysteresis coefficient Q' in the acceleration period IV is greater than the hysteresis coefficient Q in the immediately preceding low speed period III. Control is applied to increase the print speed so that when the print duty is low the energizing interval (non-energized time) is shortened based on the print speed determination factors. The thermal print head 35 may be sufficiently cooled when the low speed period III is sufficiently long, for example, and the effect of heat accumulation from driving the dot immediately before the printing dot is slight. Therefore, by increasing the hysteresis coefficient, the decrease in the energizing time of the drive signal applied to each dot affected by the hysteresis coefficient of the thermal printer is reduced, and print quality can be improved.

Figure 5:
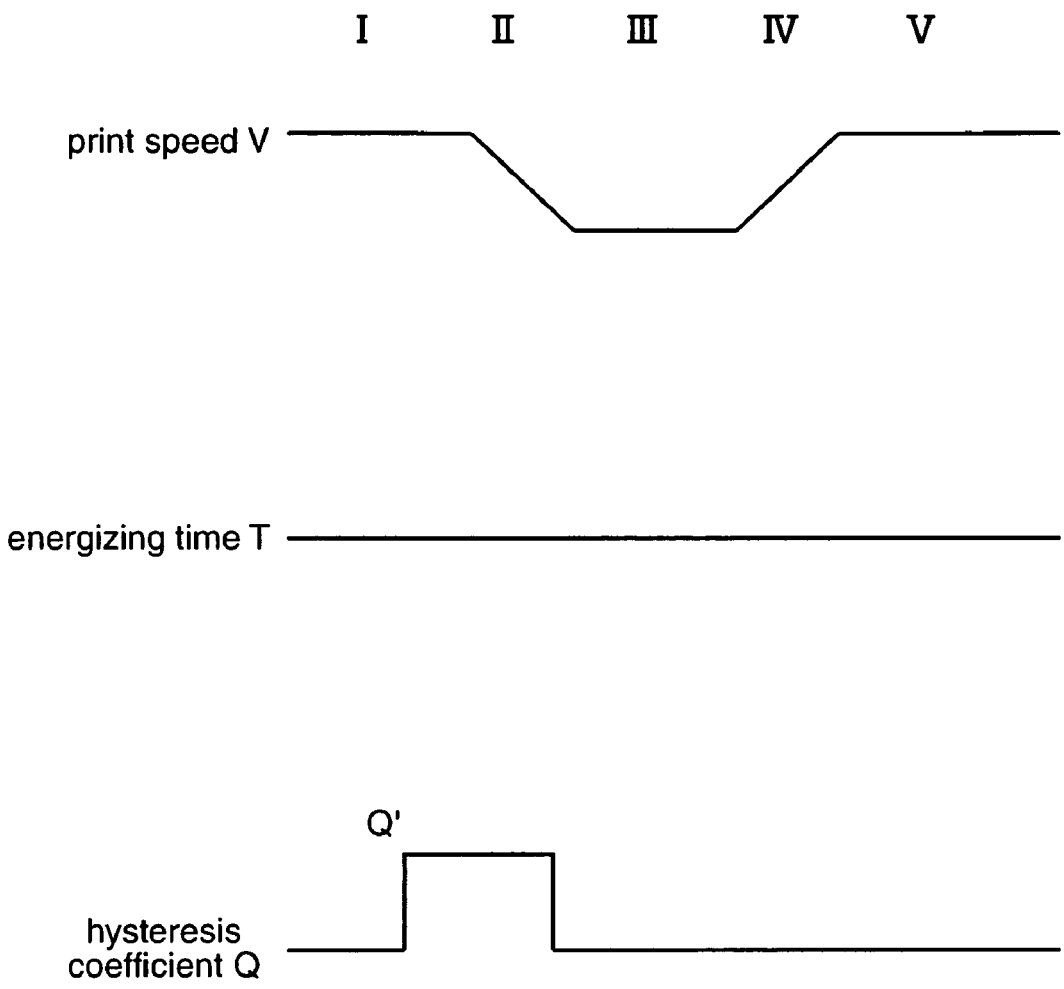
FIG. 5 shows another example of the relationship between print speed, energizing time, and the hysteresis coefficient in the printing pattern shown in FIG. 4.

The example shown in FIG. 5 is substantially identical to the example shown in FIG. 4, and differs in that the hysteresis coefficient in the acceleration period IV is the same as the hysteresis coefficient Q in the low speed period III. The hysteresis coefficient used in the acceleration period IV can also be set lower than the hysteresis coefficient Q in the low speed period III. When the low speed period III is short, the thermal print head 35 may not cool sufficiently. In this case, print quality can be improved by using a low hysteresis coefficient.

Figure 6:
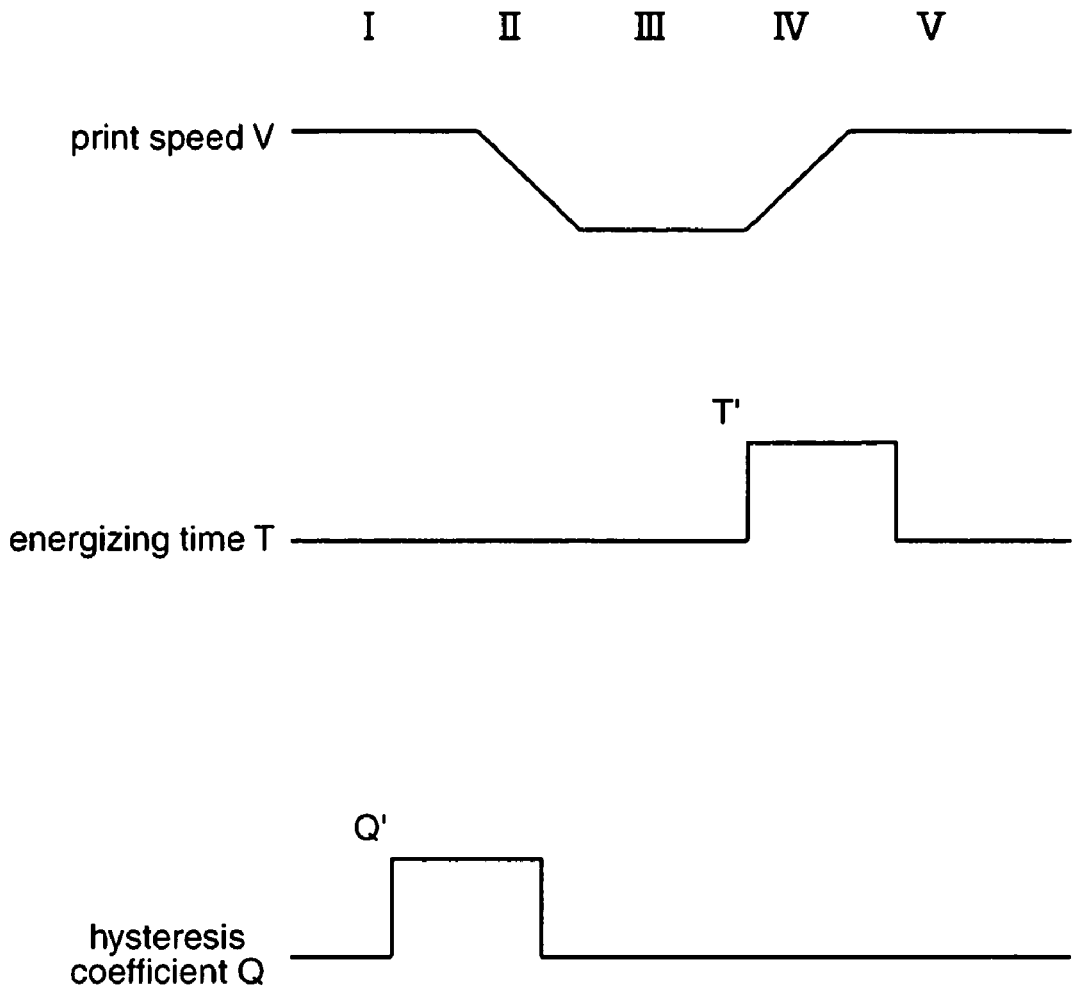
FIG. 6 shows yet another example of the relationship between print speed, energizing time, and the hysteresis coefficient in the printing pattern shown in FIG. 4.

The example shown in FIG. 6 is substantially identical to the example shown in FIG. 5, and differs in that the reference energizing time T in the acceleration period IV is increased (T->T'). As also shown in FIG. 6, the hysteresis coefficient in the acceleration period IV can also be different from the hysteresis coefficient Q in the low speed period III. When the thermal print head 35 is sufficiently cooled in the low speed period III and the printing pattern has an extremely low print duty (in the acceleration period IV), there may be substantially no change in the energizing time due to the hysteresis coefficient Q. In this case, print quality can be improved by increasing the reference energizing time T in the acceleration period IV.

Figure 7:
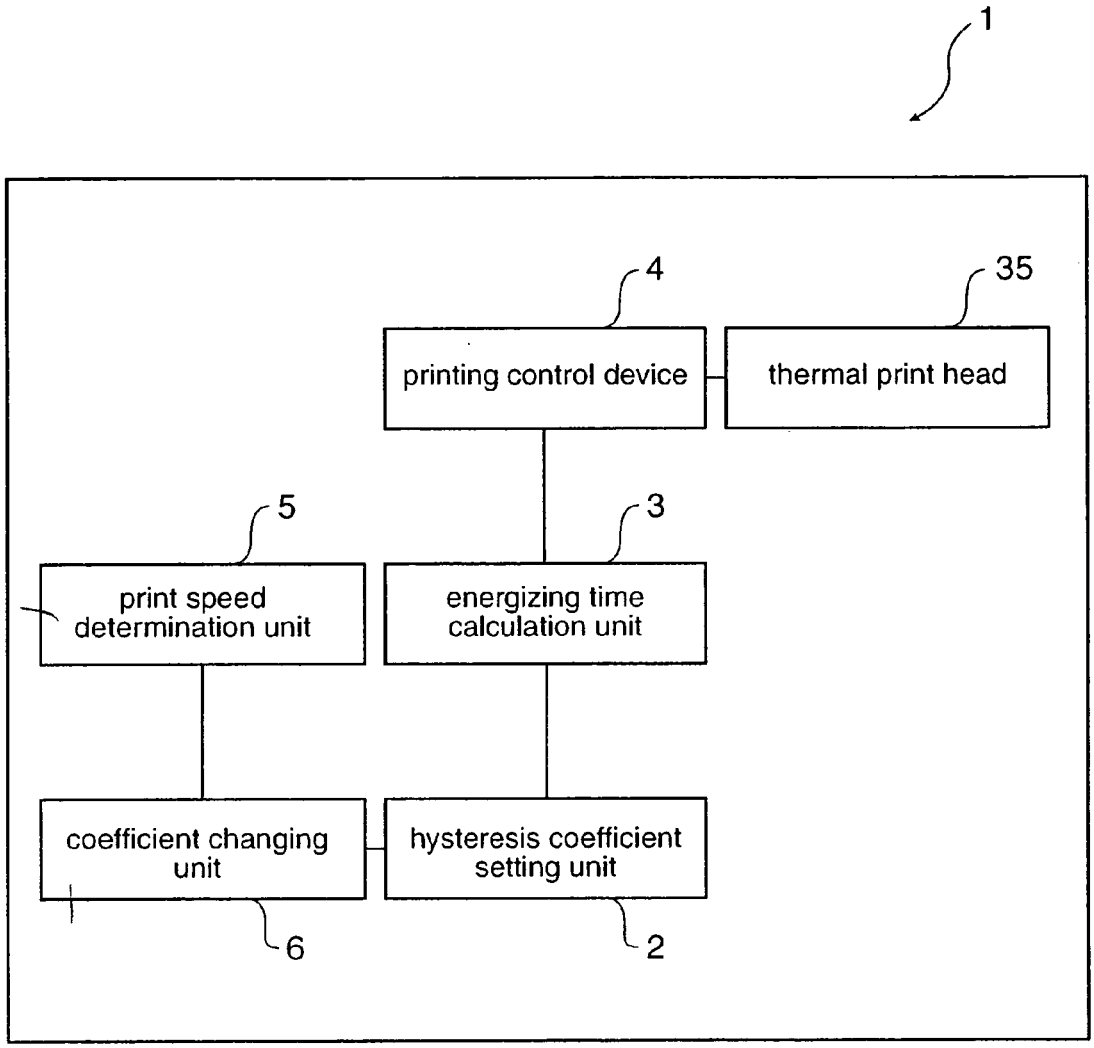
FIG. 7 is a block diagram showing the functions of a thermal printer.
Figure 8:
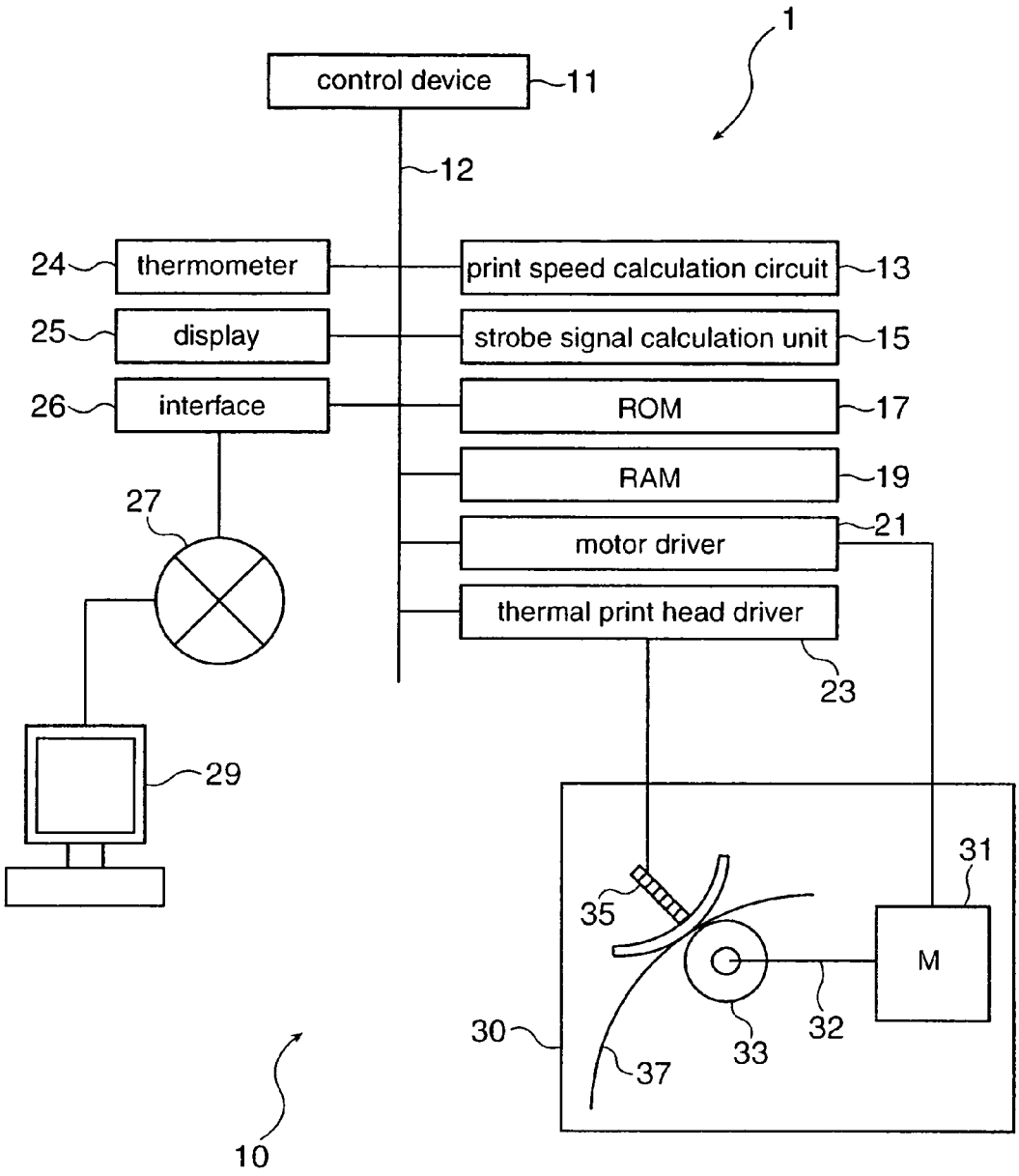
FIG. 8 shows the hardware arrangement of a thermal printer.
Figure 9:
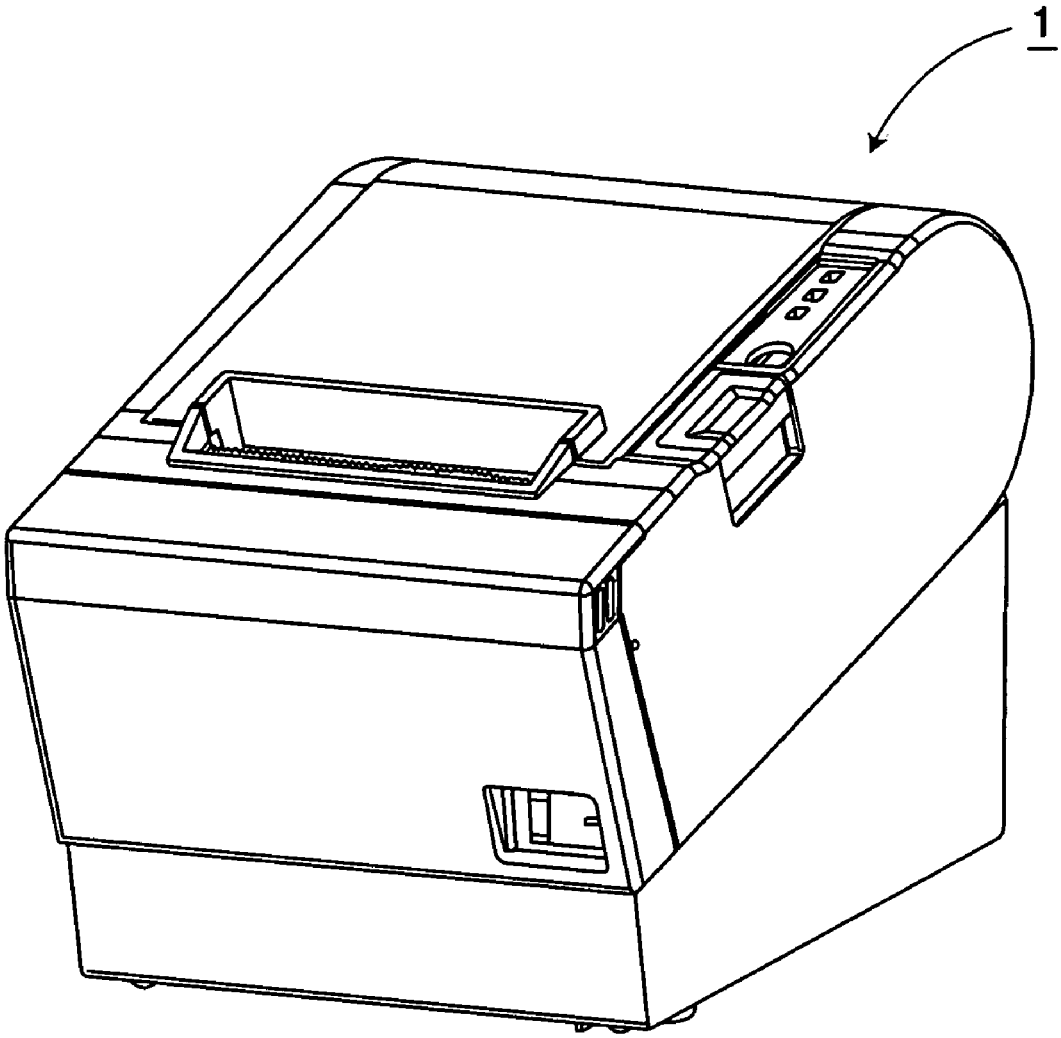
FIG. 9 is an oblique view of the thermal printer.

A thermal printer 1 according to the present invention is described hereafter in more detail with reference particularly to FIGS. 7-10. A thermal printer 1 as shown in FIG. 9 is connected to a host computer 29 such that together they form a printing system 10.

Figure 10:
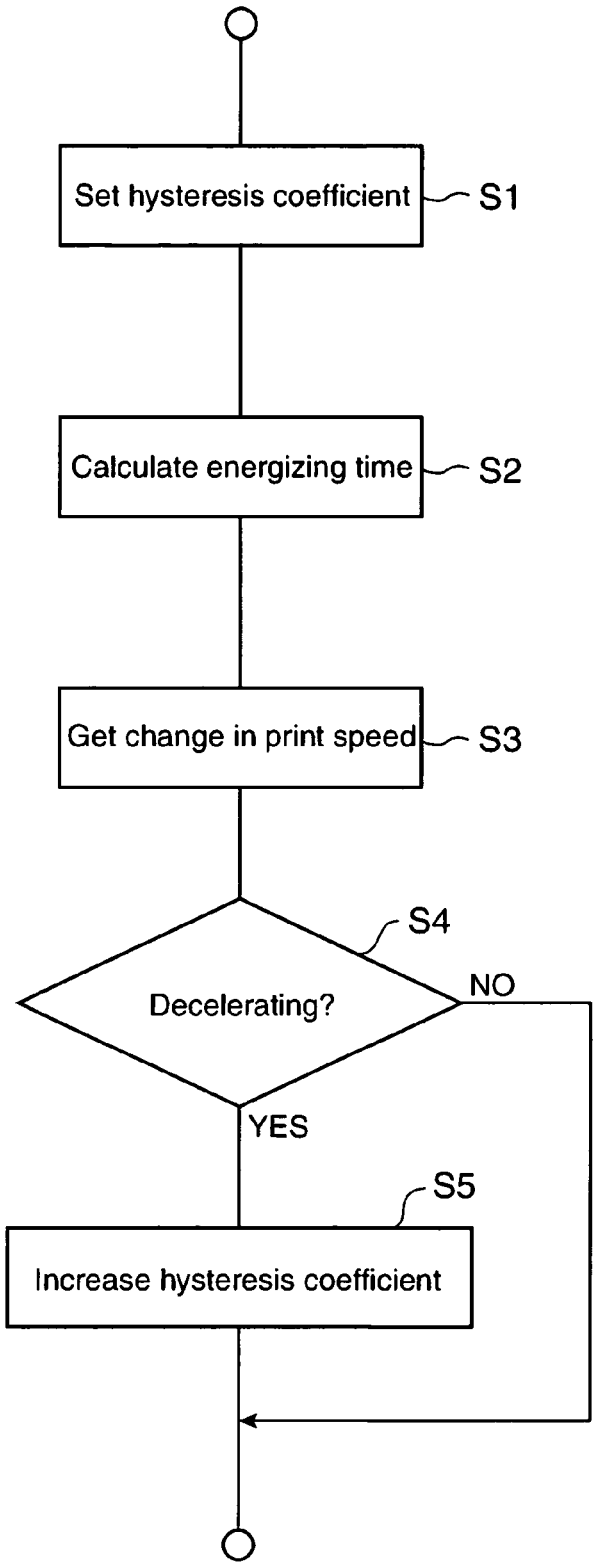
FIG. 10 is a flow chart showing the operation of the thermal printer.
Figure 11:
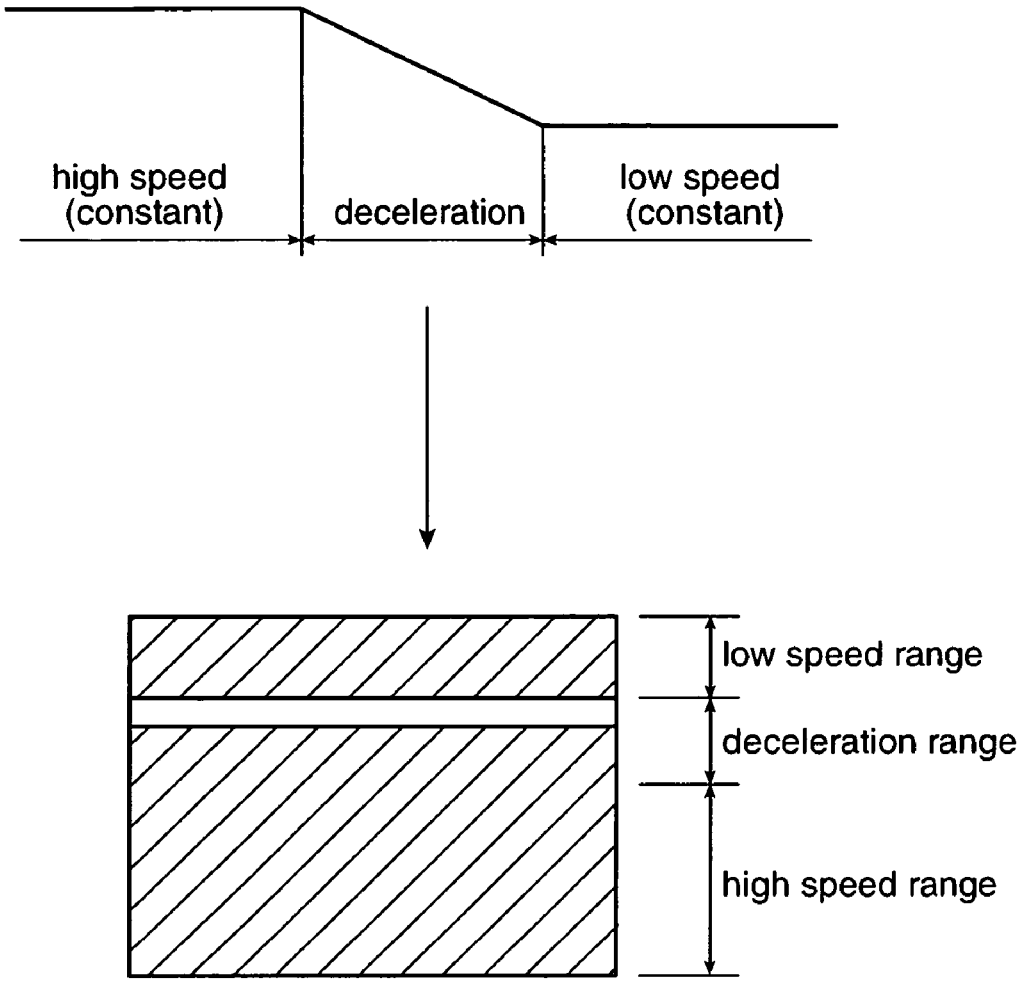
FIG. 11 schematically describes the print quality afforded by a thermal printer according to the prior art.

FIG. 7 is a functional block diagram of the thermal printer 1 with the arrangement of hardware shown in FIG. 8 and with FIG. 10 showing a flow chart of of the operation of the thermal printer 1.

The thermal printer 1 comprises a thermal print head 35, hysteresis coefficient setting unit 2, energizing time calculation unit 3, printing control device (print head control unit) 4, print speed determination unit (also referred to as the speed change acquisition unit) 5, and coefficient changing unit 6.

Based on the print duty and other print speed determination factors, the print speed determination unit 5 determines the print speed V and the state of change in the print speed V. The print speed determination unit 5 interprets commands and print data sent from the host computer 29, and calculates the print duty (counts the number of dots that actually print on each dot line) to acquire these parameters. The print speed V or change in the print speed can also be set by a command, for example, in which case the print speed V indicated by the command is stored in the print speed determination unit 5.

This is described more specifically using a printing pattern having a transition from a text printing area where the print duty is low to a printing area having a high print duty, such as when printing a logo or a solid black area where the print duty is greatest. The acquired print speed V and print speed change are high speed and constant in the text printing area (see high speed period I in FIG. 3). In the transition zone from the text printing area to the logo or solid black printing area, the print speed decreases (gradually) (deceleration period II in FIG. 3). In the logo or solid black printing area, the print speed is low (constant) (low speed period III in FIG. 3). The hysteresis coefficient in the next transition zone can be determined and set during the high speed period. By thus predicting the change in print speed based on the print duty, the thermal print head 35 energizing time can be appropriately controlled when the print speed decreases, for example, without a delay between the change in the hysteresis coefficient and the actual change in speed (deceleration).

The print data and commands can also be interpreted to determine the printing pattern. More specifically, graphic data (such as a logo or printing a solid black area) and text data (text information) can be differentiated based on the print data and commands.

The hysteresis coefficient setting unit 2 reads and sets the hysteresis coefficient stored in ROM 17 described below based on the print duty acquired by the print speed determination unit 5.

The energizing time calculation unit 3 calculates the energizing time of the drive signals applied to each dot of the thermal print head 35 based on the reference energizing time T and hysteresis coefficient Q (Q'). More specifically, the energizing time is calculated as the product of the reference energizing time T and hysteresis coefficient Q (Q'). Q is 0.7 and Q' is 0.9, for example. By thus setting the hysteresis coefficient based on the print duty (print data), the thermal print head 35 energizing time can be appropriately controlled with no delay between setting the hysteresis coefficient and the temperature change. A hysteresis coefficient is applied to all of the heating elements in the thermal print head 35 to print uniform dots. Alternatively, the energizing history of each dot can be acquired from the print data stored in memory or from the host computer 29 and the hysteresis coefficient can be set separately for each dot. Further alternatively, a combination of plural hysteresis coefficients can be used.

The printing control device 4 generates the drive signals based on the calculated energizing time, and applies the resulting drive signals to the thermal print head 35. Each driven dot heats for a time determined by the energizing time of the drive signal (the strobe signal pulse width), and causes the thermal paper 37 held between the thermal print head 35 and platen roller 33 described below to change color.

When the print speed determination unit 5 determines that the print speed is decreasing, that is, the transition zone (deceleration period 11) described above is detected, the coefficient changing unit 6 changes the hysteresis coefficient used in the deceleration period to a value Q' that is greater than the hysteresis coefficient Q used when the print speed is constant, such as when printing text (in high speed period 1).

The values of reference energizing time T, and hysteresis coefficients Q, Q' can be predetermined and stored in memory, or set by a command and stored for use.

Referring to FIG. 8, the control device 11 is a common CPU that controls other components connected to a bus 12, and processes data according to a control program read from ROM 17.

RAM 19 temporarily stores commands and print data sent from the host computer 29 over a network 27 (such as the Internet or an intranet) and received by a suitable interface 26.

The print speed calculation circuit 13 analyzes the print data and commands stored in RAM 19 based on a control program stored in a specific area in ROM 17, and determines the print speed V from the start of printing to the end of printing.

ROM 17 stores the reference energizing time T and the hysteresis coefficients Q and Q'. Rewritable nonvolatile memory such as flash ROM can be used instead of ROM 17.

The motor driver 21 controls driving the stepping motor 31 of the 30 to achieve the print speed V determined by the print speed calculation circuit 13. Drive torque from the stepping motor 31 is transferred through a transfer mechanism 32 comprising a gear train to the platen roller 33.

The strobe signal calculation circuit 15 reads the reference energizing time T and hysteresis coefficient Q (Q') from RAM 19 based on the print speed V calculated by the print speed calculation circuit 13. The strobe signal calculation circuit 15 then corrects the reference energizing time T based on the hysteresis coefficient, and adjusts the drive signal energizing time. Based on this drive signal, the thermal print head driver 23 causes specific dots of the thermal print head 35 to heat and print a dot on the thermal paper 37.

The thermometer 24 is a thermistor, for example, for measuring the temperature of the thermal print head 35. The temperature of the thermal print head 35 is an important parameter (print speed determination factor) used to control the print speed V, and the print speed V determined by analyzing the print data is preferably corrected based on the temperature of the thermal print head 35 measured by the thermometer 24.

The thermal printer 1 drive status and other information useful to the user is displayed on the display 25. The display 25 may be a liquid crystal display panel or LEDs, for example.

The control method of this thermal printer 1 is described next. The reference energizing time T is preset based on the print speed determination factors. As described above, the hysteresis coefficient is set based on the print duty calculated from the print data and commands (S1 in FIG. 10). Based on the hysteresis coefficient Q, the drive signal energizing time is then calculated (S2). The state of change in the print speed is then determined based on the change in the print duty acquired from the print data and commands (S3). If the print speed is decreasing (deceleration) (S4 returns Yes), the hysteresis coefficient used in the deceleration period is changed to a value greater than the hysteresis coefficient Q used when the print speed is constant (S5). Based on this hysteresis coefficient Q', the drive signal energizing time is calculated and the drive signal is applied to the thermal print head 35.

This control method can reduce the adjustment (decrease) in the energizing time of the drive signal applied to each dot of the thermal print head 35. More specifically, good print quality can be assured by appropriately changing the hysteresis coefficient when the print speed changes. As a result, unstable print quality can be prevented when the print speed is slowing because the dots of the thermal print head 35 will not overheat or overcool, and variations in print density and the appearance of white streaks can be prevented. Good print quality can therefore be assured even in areas where the thermal paper 37 is decelerating.

Figure 1:
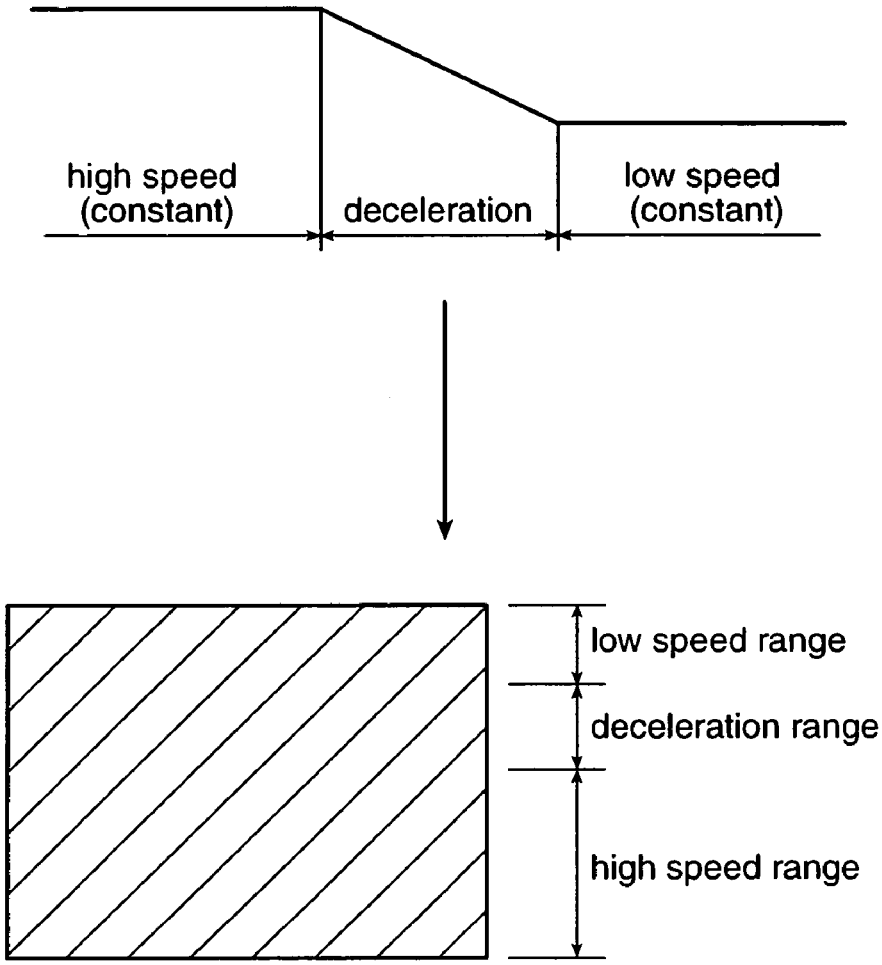
FIG. 1 schematically describes the print quality afforded by a thermal printer according to a preferred embodiment of the invention.

As shown in FIG. 1, a thermal printer 1 according to this embodiment of the invention does not produce white streaks or uneven print density in the transition area from a high speed printing period (text printing) to a low speed printing area (a logo or solid black printing area).

As shown in FIG. 3 to FIG. 6, the reference energizing time T is the same and the hysteresis coefficient is lower in the low speed period III than in the deceleration period 11, and the energizing time of the dot addressed by the hysteresis coefficient is therefore shorter in this embodiment of the invention. The energizing time can also be increased or decreased in the low speed period III in order to avoid the effects of the print duty. This can be accomplished by changing the hysteresis coefficient or by changing the reference energizing time.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A thermal printer that controls print speed based on print speed control factors comprising:

a thermal print head;

a hysteresis coefficient setting unit for setting a hysteresis coefficient for the thermal print head based upon the thermal print head energizing history;

an energizing time calculation unit for calculating the energizing time during which drive signal(s) are to be applied to the thermal print head for printing based on the setting of the hysteresis coefficient;

a print head control unit for generating the drive signal(s) to be applied to the print head in response to the calculated energizing time;

a print speed determination unit for determining change in the print speed and when the print speed is decelerating; and a coefficient changing unit for changing the setting of the hysteresis coefficient when a decelerating print speed change is determined to a new setting which is greater than the hysteresis coefficient setting immediately before deceleration.

2. The thermal printer described in claim 1, wherein:

the energizing time calculation unit calculates the energizing time based on the product of the hysteresis coefficient and a predetermined reference energizing time with the reference energizing time being constant during the period immediately before deceleration.

3. The thermal printer described in claim 2 further comprising:

a print duty calculation unit for calculating the print duty based on print data stored in memory or received from a host computer;

wherein the hysteresis coefficient setting unit sets the hysteresis coefficient based on the calculated print duty.

4. The thermal printer described in claim 2, wherein the print speed determination unit determines print speed and change in print speed based upon print speed determination factors including at least one or more parameters selected from the group consisting of: the print duty, the temperature of the print head, the printing pattern, the energizing voltage applied to the print head, the print data communication speed and the time required for internal data processing.

5. The thermal printer described in claim 1 further comprising:

a print duty calculation unit for calculating the print duty based on print data stored in memory or received from a host computer;

wherein the hysteresis coefficient setting unit sets the hysteresis coefficient based on the calculated print duty.

6. The thermal printer described in claim 5, wherein the print speed determination unit determines print speed and change in print speed based upon print speed determination factors including at least one or more parameters selected from the group consisting of: the print duty, the temperature of the print head, the printing pattern, the energizing voltage applied to the print head, the print data communication speed and the time required for internal data processing.

7. The thermal printer described in claim 1, wherein the print speed determination unit determines print speed and change in print speed based upon print speed determination factors including at least one or more parameters selected from the group consisting of: the print duty, the temperature of the print head, the printing pattern, the energizing voltage applied to the print head, the print data communication speed and the time required for internal data processing.

8. A control method for a thermal printer having a print head and a print speed determination unit for controlling print speed based on print speed control factors comprising steps of:

setting a hysteresis coefficient based on a thermal print head energizing history;

calculating the energizing time during which drive signal (s) are to be applied to the thermal print head for printing based on the setting of the hysteresis coefficient;

determining change in the print speed and when the print speed is decelerating; and changing the hysteresis coefficient in response to the determination of print speed deceleration to a new hysteresis coefficient greater than the setting of the hysteresis coefficient immediately before deceleration when the print speed is determined to be decreasing.

* * * * *